US008044967B2

(12) United States Patent
Belik et al.

(10) Patent No.: US 8,044,967 B2
(45) Date of Patent: Oct. 25, 2011

(54) CONVERTING A THREE-PRIMARY INPUT COLOR SIGNAL INTO AN N-PRIMARY COLOR DRIVE SIGNAL

(75) Inventors: Oleg Belik, Eindhoven (NL); Gerben Johan Hekstra, Eindhoven (NL); Michiel Adriaanszoon Klompenhouwer, Eindhoven (NL); Erno Hermanus Antonius Langendijk, Eindhoven (NL)

(73) Assignee: Koninklijke Philips Electronics N.V. (NL)

( * ) Notice: Subject to any disclaimer, the term of this patent is extended or adjusted under 35 U.S.C. 154(b) by 1038 days.

(21) Appl. No.: 11/911,584

(22) PCT Filed: Apr. 19, 2006

(86) PCT No.: PCT/IB2006/051201

§ 371 (c)(1),
(2), (4) Date: Oct. 15, 2007

(87) PCT Pub. No.: WO2006/111926

PCT Pub. Date: Oct. 26, 2006

(65) Prior Publication Data

US 2008/0186323 A1 Aug. 7, 2008

(30) Foreign Application Priority Data

Apr. 21, 2005 (EP) ..... 05103235
Aug. 22, 2005 (EP) ..... 05107669

(51) Int. Cl.
*G09G 5/02* (2006.01)

(52) U.S. Cl. ..... 345/589; 345/88; 345/89; 345/600; 345/690; 345/694

(58) Field of Classification Search ..... None
See application file for complete search history.

(56) References Cited

U.S. PATENT DOCUMENTS 6,724,934 B1 * 4/2004 Lee et al. ..... 382/167
2005/0099426 A1 5/2005 Primerano et al.

FOREIGN PATENT DOCUMENTS

EP 1475771 A2 11/2004
WO W02006106457 A1 10/2006

OTHER PUBLICATIONS

Wen, S.: "Design of Relative Primary Luminances for Four-Primary Displays"; Displays, Elsevier, Barking, GB, vol. 26, Jul. 26, 2005, pp. 171-176, XP002353023.

* cited by examiner

*Primary Examiner* — Alexander Eisen
*Assistant Examiner* — Robin Mishler

(57) ABSTRACT

A method of converting a three-primary input color signal (IS) comprising three input components (R, G, B) per input sample into an N-primary color drive signal (DS) comprising N≧4 drive components (D1, . . . , DN) per output sample for driving N sub-pixels (SP1, . . . , SPN) of a color additive display. The N sub-pixels (SP1, . . . , SPN) have N primary colors. The method comprises adding (10), to three equations defining a relation between the N drive components (D1, . . . , DN) and the three input components (R, G, B), at least one linear equation defining a value for a combination of a first subset of the N drive components (D1, . . . , DN) and a second subset of the N-drive components (D1, . . . , DN) to obtain an extended set of equations. The first subset comprises a first linear combination (LC1) of 1≦M1<N of the N drive components (D1, . . . , DN), and the second subset comprises a second linear combination (LC2) of 1≦M2<N of the N drive components (D1, . . . , DN). The first and the second linear combination are different. The method further comprises determining (10) a solution for the N drive components (D1, . . . , DN) from the extended set of equations.

18 Claims, 3 Drawing Sheets

Figure 1:
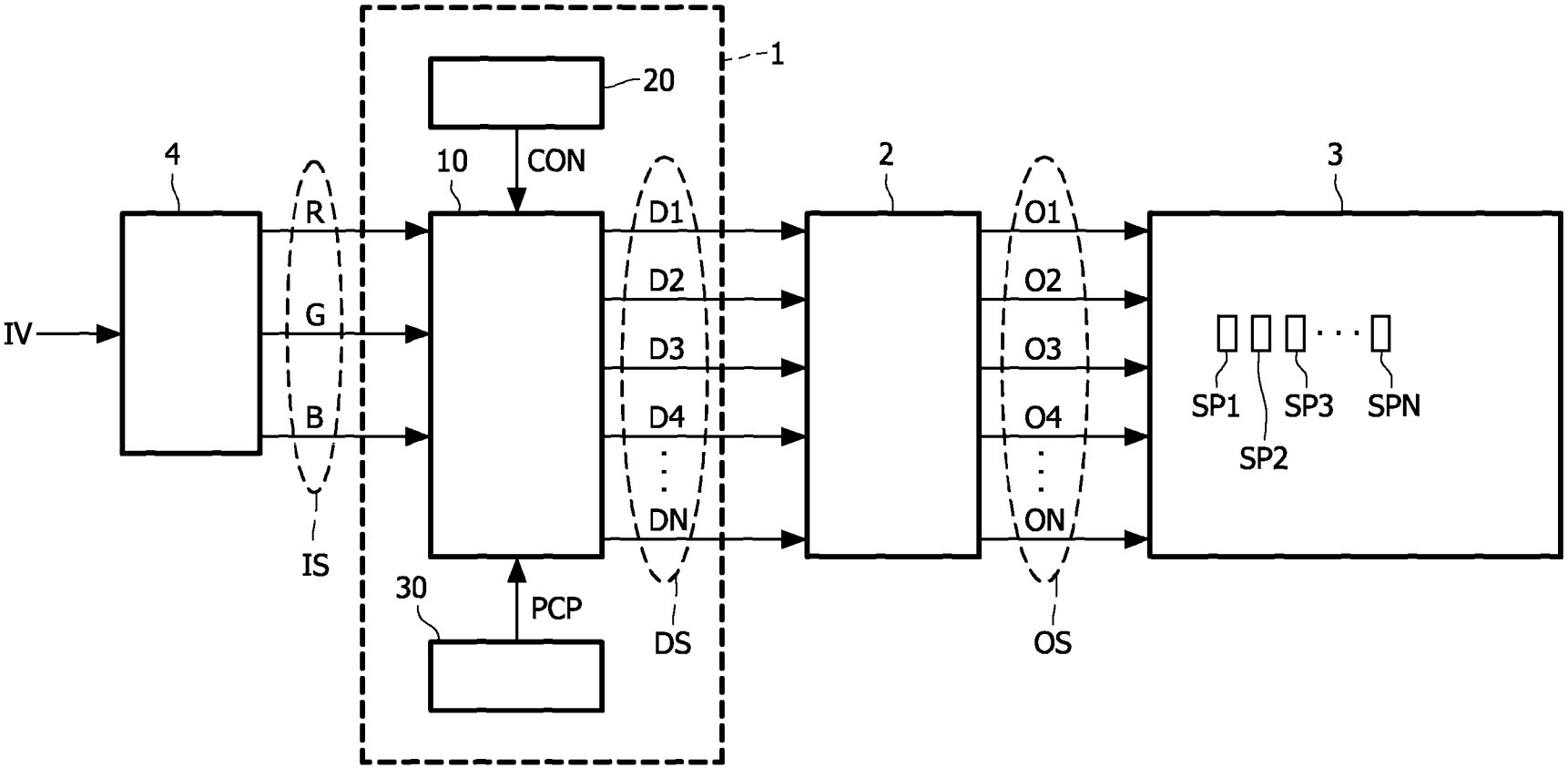

CONVERTING A THREE-PRIMARY INPUT COLOR SIGNAL INTO AN N-PRIMARY COLOR DRIVE SIGNAL

The invention relates to a method of converting a three-primary input signal into an N-primary color drive signal, to a computer program product, a system for converting a three-primary input signal into an N-primary color drive signal, a display apparatus comprising the system, a camera comprising the system, and to a portable device.

Current displays have three differently colored sub-pixels which usually have the three primary colors R (red), G (green), and B (blue). These displays are driven by three input color signals which for a display with RGB sub-pixels preferably are RGB signals. The input color signals may be any other related triplet of signals, such as for example, YUV signals. However, these YUV signals have to be processed to obtain RGB drive signals for the RGB sub-pixels. Typically, these displays with three differently colored sub-pixels have a relatively small color gamut.

Displays with four sub-pixels which have different colors provide a wider color gamut if the fourth sub-pixel produces a color outside of the color gamut defined by the colors of the other three sub-pixels. Alternatively, the fourth sub-pixel may produce a color inside the color gamut of the other three sub-pixels. The fourth sub-pixel may produce white light. Displays which have four sub-pixels are also referred to as four primary displays. A display which has sub-pixels which illuminate R (red), G (green), B (blue), and W (white) light are generally referred to as RGBW displays.

More in general, displays which have $N \geqq 4$ differently colored sub-pixels are referred to as multi-primary displays. The N drive signals for the N primary colors of the sub-pixels are calculated from the three input color signals by solving a set of equations which define the relation between the N drive signals and the three input signals. Because only three equations are available while N unknown drive signals have to be determined, usually many solutions are possible.

By increasing the number of primaries (different sub-pixels) either the resolution decreases (an area of the pixel comprising the sub-pixels increases) or the overall luminance decreases (the area of the sub-pixel decreases). Further, temporal and/or spatial flicker artifacts are noticed.

It is an object of the invention to provide a multi-primary conversion in with an amount of the temporal or spatial artifacts can be selected.

A first aspect of the invention provides a method of converting a three-primary input color signal into an N-primary color drive signal for driving N sub-pixels having N primary colors of a color additive display as claimed in claim 1. A second aspect of the invention provides a computer program product as claimed in claim 12. A third aspect of the invention provides a system for converting a three-primary input color signal into an N-primary color drive signal as claimed in claim 14. A fourth aspect of the invention provides a display apparatus as claimed in claim 15. A fifth aspect of the invention provides a camera as claimed in claim 16. A sixth aspect of the invention provides a portable device as claimed in claim 17. Advantageous embodiments are defined in the dependent claims.

In accordance with the first aspect of the invention, the method converts a three-primary input color signal into an N-primary color drive signal. The three-primary input color signal comprises a sequence of input samples. Each input sample comprises three primary color input components, which define the contributions of the three primaries to this sample. The three primary color input components are also referred to as the three input components. The N-primary color drive signal comprises a sequence of samples which each comprise N primary color drive components. The N primary color drive components are also referred to as the drive components. The N drive components may be used to drive a cluster of N sub-pixels of a color additive display device.

The colors displayed by the N sub-pixels have N primary colors, respectively. The colors of the sub-pixels are referred to as primary colors because they define the color gamut the display device is able to display. The N drive components per output sample are calculated from the three input components by solving a set of three equations which define the relation between the N drive components and the three input components. Because only three equations are available while N unknown drive components have to be determined, usually many solutions are possible. The method adds to these three equations at least one linear equation defining a value for a combination of at least a first subset of the N drive components and a second subset of the N-drive components to obtain an extended set of equations. The solution for the N drive components is determined from the extended set of equations.

The addition of the extra linear equation provides a solution of the extended set of equations for the N drive signals which fulfils the constraint defined by the linear combination. The linear combination, which usually is a weighted linear combination, defines, for example, a weighted luminance of the first and the second subset of drive components. The defined constraint causes this linear combination of the weighted luminances of the first subset and the second subset to be equal to the value. This method in accordance with the invention has the advantage that the difference between drive signals of the subsets is accurately controllable by the selection of the weighting coefficients, the linear combination and the value. The selection of this value thus determines the amount of flicker perceived.

In an embodiment as claimed in claim 2, the first subset comprises a first linear combination of $1 \leqq M1 < N$ of the N drive components, and the second subset comprises a second linear combination of $1 \leqq M2 < N$ of the N drive components. The first linear combination for $M1=1$, and/or the second linear combination for $M2=1$ comprises a single one of the N drive components only. The first linear combination defines a first value of the first subset, and the second linear combination defines a second value of the second subset. The drive components, which contribute to the second linear combination do not contribute to the first linear combination and the other way around. Thus, if the value defines a luminance difference between a first subset of the M drive components and a second subset of the N−M drive components, the additional equation is also referred to as a luminance difference constraint. The solution of the extended set of equations provides drive components such that the luminance of the sub-pixel(s) associated with the first subset of drive components is equal to the luminance of the sub-pixel(s) associated with the second subset of the drive components. It is possible to add several further equations which all provide a luminance difference constraint or which define another constraint.

The linear combination may express instead of the luminance (Y-component), also other components (X and/or Z) of in the XYZ color space, or even a value which is not related to color, but, for example to a difference in voltages.

In an embodiment as claimed in claim 3, the second linear combination is subtracted from the first linear combination to obtain a luminance difference. The value is selected to be substantially zero such that the luminance difference between the first luminance and the second luminance is substantially zero. The substantially identical first and second luminance minimizes the spatial non-uniformity or temporal flicker.

In an embodiment as claimed in claim 4, a first set of sub-pixels associated with the first subset of the M drive components and a second set of sub-pixels associated with the second subset of the N−M drive components are adjacently positioned. This minimizes the spatial luminance non-uniformity.

In an embodiment as claimed in claim 5, the first subset comprises three drive components to drive three differently colored non-white sub-pixels. The second subset comprises a fourth drive component for driving a white sub-pixel. Thus, in such a RGBW display, wherein the three differently colored non-white sub-pixels have the colors RGB (Red, Green, Blue), the luminance of the set of RGB sub-pixels is made substantially identical to the luminance of the adjacent W (white) sub-pixel. Of course, this is not possible for all values of the three-primary input color signal if the correct color and saturation should be displayed. But a clearly visible improvement is obtained if the equal luminance constraint is applied in all mappings from the three input components to the four RGBW drive components where it is possible to obtain the same luminance for the set of RGB sub-pixels on the one hand and the W sub-pixel on the other hand. In other situations, the values of the drive components may be clipped such that the correct color and an as small as possible difference between the luminances is obtained.

In this embodiment three input components have to be mapped onto four drive components and four associated sub-pixels. Thus by adding one extra equation which defines a luminance constraint a set of four equations is obtained. Consequently, a single optimal solution can be determined by solving the four drive components from the four equations.

In an embodiment as claimed in claim 6, the three input components of the same input sample of the three-primary input color signal are mapped to the adjacently positioned three non-white sub-pixels and the white sub-pixel. Because now, if possible, the luminance of the W sub-pixel and the set of RGB sub-pixels are identical, the spatial non-uniformity is minimized.

In an embodiment as claimed in claim 7, a particular input sample of a particular line of an input image defined by the three-primary input color signal is mapped to the three non-white sub-pixels. A further input sample adjacent to the particular input sample is mapped to the white pixel. This drive algorithm provides a higher resolution but is more sensitive to spatial non-uniformity. The equal luminance constraint for the white sub-pixel and the set of three non-white sub-pixels minimizes the spatial non-uniformity.

In an embodiment as claimed in claim 8, the color point of the white pixel coincides with the white point of the three non-white sub-pixels. This gives rise to very simple equations.

In an embodiment as claimed in claim 9, the display is a spectral sequential display wherein the first subset is displayed in a first frame and the second subset is displayed in a second frame succeeding the first frame. If possible at the particular input signal, the luminance produced by the first subset of pixels is made equal to the luminance produced by the second subset and thus the temporal flicker is minimized.

In an embodiment as claimed in claim 10, the first subset comprises a first set of two drive components for driving a first set of two sub-pixels. The second subset comprises a second set of drive components for driving a second set of two sub-pixels. The sub-pixels of the second set have other primary colors than the sub-pixels of the first set. Now, the mapping from the three input components to the four drive components is selected such that the temporal flicker is minimized. For example, the first set comprises the R and G sub-pixels, and the second set comprises the B and Y (yellow) sub-pixels.

In an embodiment as claimed in claim 11, the N drive components have valid ranges wherein their values are valid. In a practical realization, the drive values are limited to a range which is called the valid range. For example if the drive values are 8 bit digital words, their valid range covers 0 to 255. It is determined whether the solution of the extended set of equations provides values of the N drive components which are within their valid range. If not, at least one of the values of the N drive components which are outside their valid range is clipped to the nearest border of its valid range. The determination of the valid range of the fourth drive signal is elucidated in detail in the not yet published European patent application 05102641.7, corresponding to International Patent Application Publication No. WO 2006/106457, which is herewith incorporated by reference.

In an embodiment as claimed in claim 12 the three input components have to be mapped onto four drive components (N=4). Now, three of the four drive components can be expressed as a function of the remaining fourth drive component. The valid range of the fourth drive component is the range of the fourth drive component wherein all the four drive components, and thus their functions, have valid values. If the solution of the four equations provides a fourth drive component within its valid range, this value of the fourth drive component fulfils the equal luminance constraint. If the solution provides a value of the fourth drive component outside the valid range of the fourth drive component, the value of the fourth drive component is clipped to the nearest border of the valid range of the fourth drive component.

These and other aspects of the invention are apparent from and will be elucidated with reference to the embodiments described hereinafter.

Figure 2:
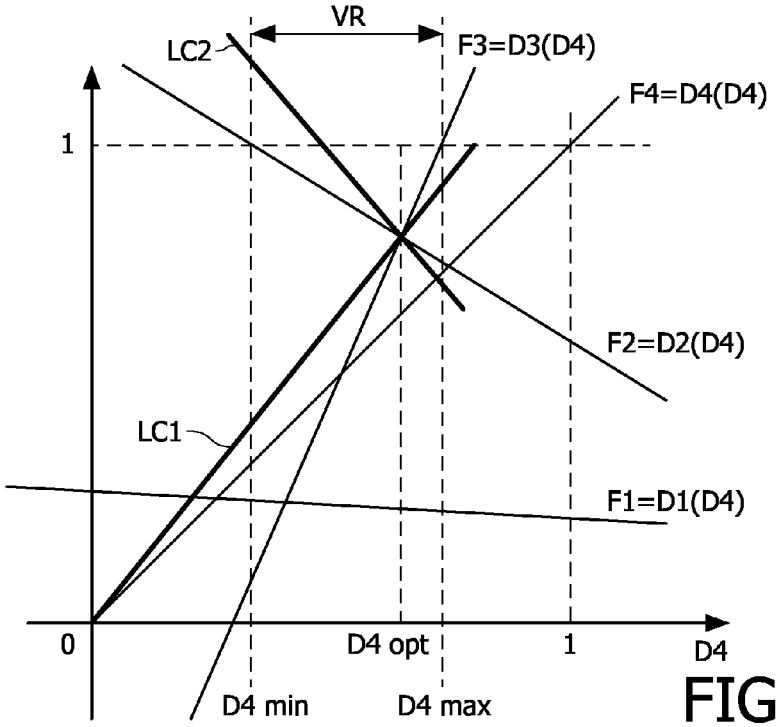
Figure 3:
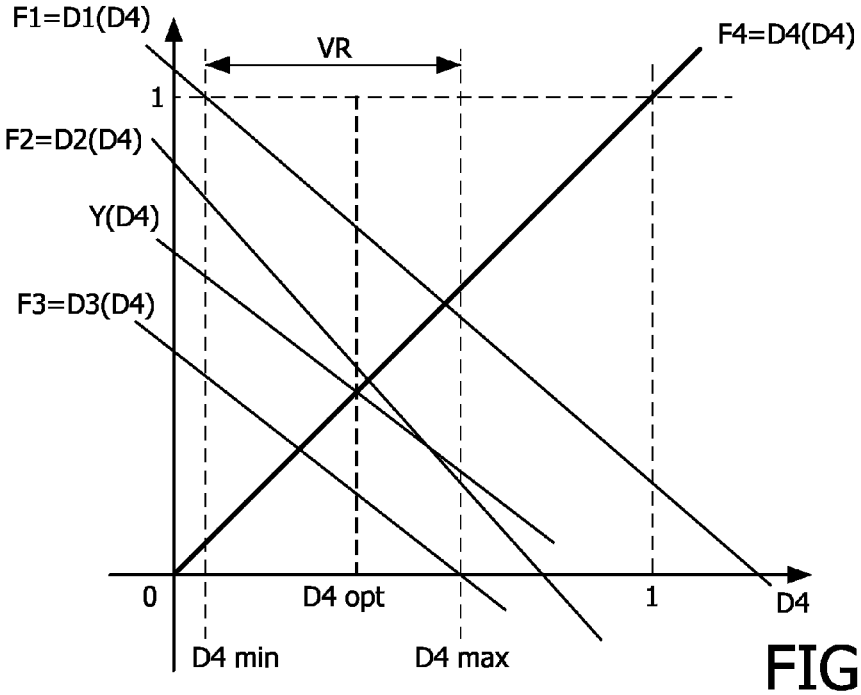
Figure 4:
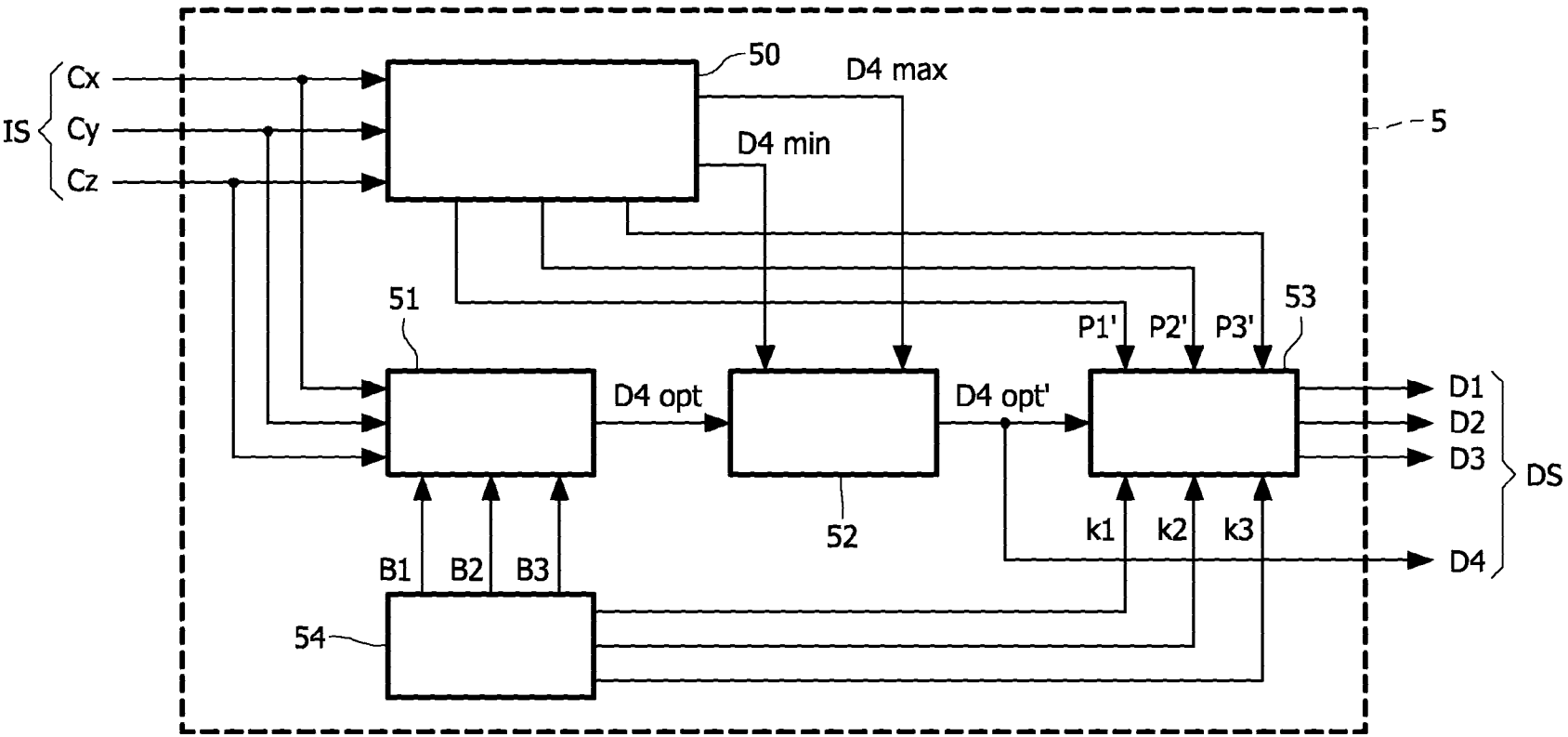

In the drawings:

FIG. 1 shows schematically a block diagram of a display apparatus which comprises a system for converting a three-primary input color signal into an N-primary color drive signal, FIG. 2 shows a graph for elucidating an embodiment of the additional equation, FIG. 3 shows a graph for elucidating another embodiment of the additional equation, and FIG. 4 shows a block diagram of an embodiment of an implementation of the conversion in accordance with the invention.

It should be noted that items which have the same reference numbers in different Figures, have the same structural features and the same functions, or are the same signals. Where the function and/or structure of such an item have been explained, there is no necessity for repeated explanation thereof in the detailed description.

FIG. 1 shows schematically a block diagram of a display apparatus which comprises a system for converting a three-primary input color signal into an N-primary color drive signal. The system 1 for converting the three-primary input color signal IS into an N-primary color drive signal DS comprises a multi-primary conversion unit 10, a constraint unit 20, and a parameter unit 30. These units may be hardware or software modules. The constraint unit 20 provides a constraint CON to the conversion unit 10. The parameter unit 30 provides primary color parameters PCP to the conversion unit 10.

The conversion unit 10 receives the three-primary input signal IS and supplies an N-primary drive signal DS. The three-primary input signal IS comprises a sequence of input samples which each comprise three input components R, G, B. The input components R, G, B of a particular input sample define the color and intensity of this input sample. The input samples may be the samples of an image which, for example, is produced by a camera or a computer. The N-primary drive signal DS comprises a set of drive samples which each comprise N drive components D1 to DN. The drive components D1 to DN of a particular output sample define the color and intensity of the drive sample. Usually the drive samples are displayed on pixels of a display device 3 via a drive circuit 2 which processes the drive samples such that output samples are obtained suitable to drive the display 3. The drive components D1 to DN define the drive values O1 to ON for the sub-pixels SP1 to SPN of the pixels. In FIG. 1 only one set of the sub-pixels SP1 to SPN is shown. For example, in a RGBW display device the pixels have four sub-pixels SP1 to SP4 which supply red (R), green (G), blue (B), and white (W) light. A particular drive sample has four drive components D1 to D4 which give rise to four drive values O1 to O4 for the four sub-pixels SP1 to SP4 of a particular pixel.

The display apparatus further comprises a signal processor 4 which receives the input signal IV which represents the image to be displayed, to supply the three-primary input signal IS. The signal processor 4 may be a camera, the input signal IV is than not present. The display apparatus may be part of a portable device such as, for example, a mobile phone or a personal digital assistant (PDA).

FIG. 2 shows a graph for elucidating an embodiment of the additional equation. FIG. 2 shows an example wherein N=4. The graph shows the three drive components D1 to D3 as a function of the fourth drive component D4. The fourth drive component D4 is depicted along the horizontal axis, and the three drive component s D1 to D3 together with the fourth drive component D4 along the vertical axis. Usually, the drive components D1 to D4 are used to drive sets of sub-pixels of the display 3, and in the now following are also referred to as drive signals. The drive components D1 to D4 of a same drive sample may drive the sub-pixels of a same pixel. Alternatively, the drive components D1 to D4 of adjacent samples may be sub-sampled to sub-pixels of the same pixel. Now, not all drive components D1 to D4 are actually assigned to a sub-pixel.

The three drive signals D1 to D3 are defined as functions of the fourth drive signal D4: F1=D1(D4), F2=D2(D4), and F3=D3(D4). The fourth drive signal D4 is a straight line through the origin and has a first derivative which is one. The valid ranges of the four drive signals D1 to D4 are normalized to the interval 0 to 1. The common range VR of the fourth drive signal D4 in which all the four drive signals D1 to D4 have values within their valid ranges extends from the value D4min to D4max, and includes these border values.

In this example, a linear light domain is selected wherein the functions defining the three drive signals D1 to D3 as a function of the fourth drive signal D4 are defined by the linear functions:

$$\begin{bmatrix} D1 \\ D2 \\ D3 \end{bmatrix} = \begin{bmatrix} P1' \\ P2' \\ P3' \end{bmatrix} + \begin{bmatrix} k1 \\ k2 \\ k3 \end{bmatrix} \times D4$$

wherein D1 to D3 are the three drive signals, (P1', P2', P3') are defined by the input signal which usually is a RGB signal, and the coefficients ki define a dependence between the color points of the 3 primaries associated with the 3 drive values D1 to D3, and the primary associated with the fourth drive signal D4. Usually these coefficients are fixed and can be stored in a memory.

To further elucidate the relation between the elements of these functions it is now shown how the above functions relate to the standard three to four primary conversion. In a standard three to four primary conversion, the drive signal DS, which comprises the drive signals D1 to D4, is transformed to the linear color space XYZ by the following matrix operation.

$$\begin{bmatrix} Cx \\ Cy \\ Cz \end{bmatrix} = \begin{bmatrix} t11 & t12 & t13 & t14 \\ t21 & t22 & t23 & t24 \\ t31 & t32 & t33 & t34 \end{bmatrix} \times \begin{bmatrix} D1 \\ D2 \\ D3 \\ D4 \end{bmatrix} = [T] \times \begin{bmatrix} D1 \\ D2 \\ D3 \\ D4 \end{bmatrix} \quad \text{Equation 1}$$

The matrix with the coefficients tij defines the color coordinates of the four primaries of the four sub-pixels. The drive signals D1 to D4 are unknowns which have to be determined by the multi-primary conversion. This equation 1 cannot be solved immediately because there are multiple possible solutions as a result of introducing the fourth primary. A particular selection out of these possibilities for the drive values of the drive signals D1 to D4 is found by applying a constraint which is a fourth linear equation added to the three equations defined by Equation 1.

This fourth equation is obtained by defining a value to a linear combination of a first subset of the N drive components D1, . . . , DN and a second subset of the N-drive components D1, . . . , DN. The first subset comprises a first linear combination LC1 of 1≦M1<N of the N drive components D1, . . . , DN, and the second subset comprising a second linear combination LC2 of 1≦M2<N of the N drive components D1, . . . , DN. The first and the second linear combinations are different. Both the first and the second linear combination may comprise only one drive component or several drive components. The solution for the N drive components D1, . . . , DN is found by solving the extended set of equations. Preferably, the drive components which are in the first set are not in the second set and the other way around such that the linear combinations LC1 and LC2 refer to different sub-groups of the sub-pixels which belong to the same pixel.

In this example, the linear combination LC1 is related to a weighted luminance of a first sub-group of sub-pixels of a pixel, and the linear combination LC2 is related to a weighted luminance of a second sub-group of other sub-pixels of the same pixel. The extra equation thus defines a linear combination of weighted luminances which should be equal to the value. The first sub-group of sub-pixels and the second sub-group of sub-pixels may comprise only one sub-pixel, and need not contain together all the sub-pixels of a pixel.

Preferably, the first linear combination LC1 defines the luminance of the drive components of the first subset, and the second linear combination defines the luminance of the drive components of the second subset. Thus, the linear combination LC1 is directly indicative for the luminance produced by the sub-pixels which are associated with the drive components which are a member of the first subset. And, the linear combination LC2 is directly indicative for the luminance produced by the sub-pixels which are associated with the drive components which are member of the second subset. The value defines a constraint to a linear combination of these luminances. For example, this constraint defines that the luminance of the first linear combination should be equal to the luminance of the second linear combination to obtain a minimum amount of artifacts caused by too different luminances of the adjacent sub-pixels SP1 to SPN of the same pixel. For such an equal luminance constraint, the linear combination of the first and second subset is a subtraction, and the value is substantially zero. Such an equal luminance constraint will be elucidated for different embodiments with respect to FIGS. 2 and 3.

But first, in the now following, it is elucidated how the functions defining the three drive signals D1 to D3 as a function of the fourth drive signal D4 are determined.

Equation 1 can be rewritten into:

$$\begin{bmatrix} Cx \\ Cy \\ Cz \end{bmatrix} = [A] \times \begin{bmatrix} D1 \\ D2 \\ D3 \end{bmatrix} + \begin{bmatrix} t14 \\ t24 \\ t34 \end{bmatrix} \times D4 \qquad \text{Equation 2}$$

$$A = \begin{bmatrix} t11 & t12 & t13 \\ t21 & t22 & t23 \\ t31 & t32 & t33 \end{bmatrix}$$

wherein the matrix [A] is defined as the transforming matrix in the standard three primary system. Multiplication of the terms of equation 2 with the inverse matrix $[A^{-1}]$ provides Equation 3.

$$\begin{bmatrix} P1' \\ P2' \\ P3' \end{bmatrix} = \begin{bmatrix} D1 \\ D2 \\ D3 \end{bmatrix} + [A^{-1}] \times \begin{bmatrix} t14 \\ t24 \\ t34 \end{bmatrix} \times D4 \qquad \text{Equation 3}$$

The vector [P1' P2' P3'] represents primary values obtained if the display system only contains three primaries and is defined by the matrix multiplication of the vector [Cx Cy Cz] with the inverse matrix $[A^{-1}]$. Finally, Equation 3 is rewritten into Equation 4.

$$\begin{bmatrix} D1 \\ D2 \\ D3 \end{bmatrix} = \begin{bmatrix} P1' \\ P2' \\ P3' \end{bmatrix} + \begin{bmatrix} k1 \\ k2 \\ k3 \end{bmatrix} \times D4 \qquad \text{Equation 4}$$

Thus, the driving signal of any three primaries D1 to D3 is expressed by Equation 4 as a function of the fourth primary D4. These linear functions F1 to F3 define three lines in a two-dimensional space defined by the fourth primary D4 and the values of the fourth primary D4 as is illustrated in FIG. 2 All values in FIG. 2 are normalized which means that the values of the four drive values D1 to D4 have to be within the range $0 \leqq Di \leqq 1$. From FIG. 2 it directly visually becomes clear what the common range VR of D4 is for which all the functions F1 to F3 and the fourth drive signal D4 have values which are in the valid range. It has to be noted that the coefficients k1 to k3 are predefined by the color coordinates of the sub-pixels associated with the drive values D1 to D4.

In the example shown in FIG. 2, the boundary D4min of the valid range VR is determined by the function F2 which has a higher value than 1 for values of D4 smaller than D4min. The boundary D4max of the valid range VS is determined by the function F3 which has a higher value than 1 for values of D4 larger than D4max. Basically, if no such common range VR exists, then the input color is outside the four primary color gamut and thus cannot be correctly reproduced. For such colors a clipping algorithm should be applied which clips these colors to the gamut. A scheme which calculates the common range D4min to D4max is elucidated in the non pre-published European patent application 05102641.7, which is incorporated herewith by reference. The existence of the common range VR indicates that many possible solutions exist for the conversion from the particular values of the three input components R, G, B to the four drive components D1 to D4. The valid range VR contains all possible values of the drive component D4 which provide a conversion for which the intensity and color of the four sub-pixels is exactly corresponding to that indicated by the three input components R, G, B. The values of the other three drive components D1 to D3 are found by substituting the selected value of the drive component D4 into Equation 4.

FIG. 2 further shows the lines LC1 and LC2. The line LC1 represents the luminance of the drive component D4, the line LC2 represents the luminance of the drive components D1 to D3. Thus, the first subset of the N drive components only comprises the weighted drive component D4 to represent the luminance of the associated sub-pixel. The second subset of the N drive components comprises a weighted linear combination of the three drive components D1 to D3 such that this linear combination represents the luminance of the combination of the sub-pixels associated with these three drive components D1 to D3. At the intersection of these lines LC1 and LC2, which occurs for the drive value D4opt, the luminance of the drive component D4 is equal to the luminance of the combination of the drive components D1 to D3.

This equal luminance constraint is especially interesting for a spectral sequential display 3 which drives one set of the primaries during the even frames and the remaining set of primaries during the odd frames. The algorithm processes a given input color defined by the input components R, G, B under the equal luminance constraint into output components D1 to DN such that the luminance generated by the first subset of sub-pixels during the even frames is equal to the luminance generated by the second subset of the sub-pixels during the odd frames. Thus, the first subset of the N drive components drives the first subset of sub-pixels during the even frames, and the second subset of the N drive components drives the second subset of the sub-pixel during the odd frames, or the other way around. If for a given input color it is impossible to reach an equal luminance during both frames, either the input color is clipped to a value which allows equal luminances, or the output components are clipped to obtain an as equal as possible luminance.

For example, in a RGBY display (R=red, G=green, B=blue, and Y=yellow), only the blue and green sub-pixels are driven in the even frames while only the red and yellow sub-pixels are driven in the odd frames, or the other way around. Of course any other combination of colors is possible also. In this example, in FIG. 2, the two lines LC1 and LC2 should represent the luminance of the blue plus green drive components, and the luminance of the yellow and red drive components, respectively. The value D4opt of the drive component D4 at which these two lines LC1 and LC2 intersect is the optimal value at which the luminance of the blue and green sub-pixels is equal to the luminance of red and yellow sub-pixels. This approach minimizes temporal flicker.

In fact, Equation 1 has been extended by adding a fourth row to the matrix T. The fourth row defines the additional equation $$t21*D1+t22*D2-t23*D3-t24*D4=0$$

The coefficients are t21 to t24 because Cy defines the luminance. The first subset contains the linear combination of the drive values D1 and D2, the second subset contains the linear combination of the drive values D3 and D4, and the value is zero. This additional equation adds an equal luminance constraint to Equation 1. Thus, the solution of the extended equation provides equal luminances for the sub-pixels SP1 and SP2 which are driven by the drive components D1 and D2 on the one hand, and for the sub-pixels SP3 and SP4 which are driven by the drive components D3 and D4 on the other hand. The extended equation is defined by $$\begin{bmatrix} Cx \\ Cy \\ Cz \\ 0 \end{bmatrix} = \begin{bmatrix} t11 & t12 & t13 & t14 \\ t21 & t22 & t23 & t24 \\ t31 & t32 & t33 & t34 \\ t21 & t22 & -t23 & -t24 \end{bmatrix} \times \begin{bmatrix} D1 \\ D2 \\ D3 \\ D4 \end{bmatrix} = [TC] \times \begin{bmatrix} D1 \\ D2 \\ D3 \\ D4 \end{bmatrix} \quad \text{Equation 5}$$

Equation 5 can be easily solved by calculating $$\begin{bmatrix} D1 \\ D2 \\ D3 \\ D4 \end{bmatrix} = \begin{bmatrix} TC11 & TC12 & TC13 & TC14 \\ TC21 & TC22 & TC23 & TC24 \\ TC31 & TC32 & TC33 & TC34 \\ TC41 & TC42 & TC43 & TC44 \end{bmatrix} \times \begin{bmatrix} Cx \\ Cy \\ Cz \\ 0 \end{bmatrix} = [TC^{-1}] \times \begin{bmatrix} Cx \\ Cy \\ Cz \\ 0 \end{bmatrix}$$

wherein $[TC^{-1}]$ is the inverse matrix of [TC].

The solution for the drive components D1 to D4 makes sense if all drive components D1 to D4 have valid values, which if normalized, is true if $0 \leqq Di \leqq 1$ for i=1 to 4. For some input colors defined by the input components R, G, B this will not be achievable. The optimal drive value D4opt of the drive component D4 corresponds to the drive value allowing flicker free operation, and is defined by $$D4opt = TC41*Cx + TC42*Cy + TC43*Z \quad \text{Equation 6}$$

The coefficients TC41, TC42, TC43 do not depend on the input color. The values of the other drive components D1 to D4 are calculated by using Equation 4. As long as the optimal drive value D4opt occurs within the valid range VR, the solution provides equal luminance in both even and odd sub-frames.

If the optimal value D4opt does not occur within the valid range VR, this value is clipped to the nearest boundary value D4min or D4max, and this clipped value is used to determine the values of the other drive components D1 to D3 with Equation 4. Now, the luminance is not equal in both even and odd sub-frames. However, due by the clipping towards the nearest boundary value, a minimal error occurs. The luminance error is defined by $$\Delta L = (t21*D1 + t22*D2) - (t23*D3 + t24*D4)$$

which by substitution of Equation 4 therein provides $$\Delta L = (P1'*t21 + P2'*t22 - P3'*t23) + D4opt(k1*t21 + k2*t22 - k3*t23 - t24)$$

which is zero if D4opt is not clipped. However, the clipping adds an error to ΔD4 to the optimal value D4opt. The resulting luminance error is $$\Delta L = \Delta D4(k1*t21 + k2*t22 - k3*t23 - t24)$$

It has to be noted that the term k1*t21+k2*t22−k3*t23−t24 is a constant, and thus the luminance error ΔL is determined only by the value of the error ΔD4. Consequently, the minimal error of the drive component D4 causes a minimal error of the luminances of the sub-pixels groups during the different sub-frames.

The method of converting the three input components R, G, B into the four drive components D1 to D4 by adding the fourth equal luminance equation to the three equations which define the relation between the three input components R, G, B and the four drive components D1 to D4 is very efficient for any spectrum sequential display with four primary colors supplied by four sub-pixels SP1 to SP2. There are no limitations with respect to the color points of the primary colors. The algorithm can also directly be used for six-primary systems as a part of the conversion. The algorithm can also be used for any other number of primaries (sub-pixels per pixel) higher than 4. But, usually, this leads to a range of possible solutions if no further constraints are implemented. One advantage of this approach is that large and costly look-up tables are avoided. The conversion is low-cost because per sample only 17 multiplications, 14 additions, two min/max operations have to be performed.

FIG. 3 shows a graph for elucidating another embodiment of the additional equation. FIG. 3 shows an example wherein N=4, the display is an RGBW display, and the fourth equation defines an equal luminance constraint. In this example, in the RGBW display, the drive component D1 drives the red sub-pixel, the drive component D2 drives the green sub-pixel, the drive component D3 drives the blue sub-pixel, and the drive component D4 drives the white sub-pixel. Now, if possible at the particular values of the three input components R, G, B, the luminance of the RGB sub-pixels is kept equal to the luminance of the white pixel to minimize the spatial non-uniformity. Instead of RGBW, other colors may be used, as long as the color of the single sub-pixel can be produced by the combination of the other three sub-pixels.

FIG. 3 shows the three drive components D1 to D3 as a function of the fourth drive component D4. The fourth drive component D4 is depicted along the horizontal axis, and the three drive components D1 to D3 together with the fourth drive component D4 along the vertical axis. The drive components D1 to D4 which are used to drive the sub-pixels of the display 3, are in the now following also referred to as drive signals. The drive signals D1 to D4 of a same drive sample may drive the sub-pixels of a same pixel. Alternatively, the drive components D1 to D4 of adjacent samples may be sub-sampled to sub-pixels of the same pixel. Now, not all drive components D1 to D4 are actually assigned to a sub-pixel.

The three drive signals D1 to D3 are defined as functions of the fourth drive signal D4: F1=D1(D4), F2=D2(D4), and F3=D3 (D4). The fourth drive signal D4 is a straight line through the origin and has a first derivative which is one. In this example, a linear light domain is selected wherein the functions F1 to F3 are straight lines. The valid ranges of the four drive signals D1 to D4 are normalized to the interval 0 to 1. The common range VR of the fourth drive signal D4 in which all the three drive signals D1 to D3 have values within their valid ranges extends from the value D4min to D4max, and includes these border values.

In this embodiment, the line F4 is supposed to also indicate the luminance of the white sub-pixel SP4. The line Y(D4) indicates the combined luminance of the RGB sub-pixels SP1 to SP3 for the particular three input components R, G, B. The luminance indicated by the line Y(D4) is normalized towards the luminance of the white W sub-pixel such that at the intersection of the line Y(D4) which the line D4(D4) the combined luminance of the RGB sub-pixels SP1 to SP3 is equal to the luminance of the W sub-pixel SP4. This intersection occurs at the value D4opt of the drive component D4. Again, the values of the other drive components D1 to D3 are found by substituting D4opt in equation 4.

In a special situation wherein the chromaticity of the W sub-pixel SP4 coincides with the white point of the chromaticity diagram created by the RGB sub-pixels SP1 to SP3, the functions F1 to F3 become even simpler: all the coefficients k1 to k3 of Equation 4 have an equal negative value. Thus the lines representing the functions F1 to F3 intersect the line P4=P4 under the same angle. If further the maximal possible luminance of the W sub-pixel SP4 is equal to the maximal possible luminance of the RGB-sub-pixels SP1 to SP3, then all the coefficients k1 to k3 of Equation 4 have the value−1, and the lines representing the functions F1 to F3 intersect the line P4=P4 under 90 degrees.

This approach which adds a fourth linear equation defining an equal luminance constraint to the three equations which define the relation between the four drive components D1 to D4 and the three input components R, G, B improves the spatial homogeneity between the RGB and W sub-pixels. In fact, Equation 1 has been extended by adding a fourth row to the matrix T. The fourth row defines the additional equation $$t21*D1+t22*D2+t23*D3-t24*D4=0$$

The coefficients are t21 to t24 because Cy defines the luminance in the linear XYZ color space. The first subset contains the linear combination of the drive values D1, D2 and D3 which drive the RGB sub-pixels SP1, SP2, SP3. The second subset contains a linear combination which comprises the drive value D4 only. This additional equation adds an equal luminance constraint to Equation 1. Thus, the solution of the extended equation provides equal luminances for the combined luminance of the sub-pixels SP1, SP2 and SP3 which are driven by the drive components D1, D2 and D3 on the one hand, and for the sub-pixel SP4 which is driven by the drive component D4 on the other hand.

The extended equation is defined by $$\begin{bmatrix} Cx \\ Cy \\ Cz \\ 0 \end{bmatrix} = \begin{bmatrix} t11 & t12 & t13 & t14 \\ t21 & t22 & t23 & t24 \\ t31 & t32 & t33 & t34 \\ t21 & t22 & t23 & -t24 \end{bmatrix} \times \begin{bmatrix} D1 \\ D2 \\ D3 \\ D4 \end{bmatrix} = [TC'] \times \begin{bmatrix} D1 \\ D2 \\ D3 \\ D4 \end{bmatrix} \quad \text{Equation 7}$$

Equation 6 can be easily solved by calculating $$\begin{bmatrix} D1 \\ D2 \\ D3 \\ D4 \end{bmatrix} = \begin{bmatrix} TC11' & TC12' & TC13' & TC14' \\ TC21' & TC22' & TC23' & TC24' \\ TC31' & TC32' & TC33' & TC34' \\ TC41' & TC42' & TC43' & TC44' \end{bmatrix} \times \begin{bmatrix} Cx \\ Cy \\ Cz \\ 0 \end{bmatrix} = [TC^{-1}] \times \begin{bmatrix} Cx \\ Cy \\ Cz \\ 0 \end{bmatrix}$$

wherein $[TC'^{-1}]$ is the inverse matrix of [TC']

The optimal drive value D4opt of the drive component D4 corresponds to the drive value allowing optimal spatial homogeneity, and is thus defined by $$D4opt=TC41'*Cx+TC42'*Cy+TC43'*CZ. \quad \text{Equation 8}$$

It has to be noted that Equation 8 has the same structure as Equation 6, only the matrix coefficient are different.

As discussed for the example with respect to FIG. 2, if the optimal drive value D4opt determined occurs outside the valid range VR, this optimal drive value is clipped to the nearest boundary value D4min or D4max.

FIG. 4 shows a block diagram of an embodiment of an implementation of the conversion in accordance with the invention. The dashed block 5 is identical to the system 1 which converts the three-primary input color signal IS into an N-primary color drive signal DS. However, in FIG. 1 the three-primary input color signal IS is a RGB signal which need not be defined in a linear light domain. In FIG. 4 it is assumed that the three-primary input color signal IS is defined in the linear light domain by the input components Cx, Cy, Cz of the linear XYZ color space. The three-primary input color signal IS may be directly defined in the linear XYZ color space or may first be converted from a non-linear color space, such as the RGB color space, to the linear XYZ color space. The conversion system 5 comprises a calculation unit 51, a clipping unit 52, a calculation unit 53, an interval unit 50, and a storage unit 54. These units may be implemented as hardware or as software modules.

The interval unit 50 receives the input components Cx, Cy, and Cz and determines the border values D4min and D4max of the fourth drive component D4. The interval unit 50 further calculates the values for the vector [P1' P2' P3'] which represents primary values obtained if the display system only contains three primaries. This vector is, as elucidated with respect to Equations 2 and 3, defined by $$\begin{bmatrix} P1' \\ P2' \\ P3' \end{bmatrix} = [A^{-1}] \times \begin{bmatrix} Cx \\ Cy \\ Cz \end{bmatrix}$$

wherein $[A^{-1}]$ is the inverse matrix of the matrix [A] defined in equation 2. Thus, the value of the components P1', P2', P3' of this vector depend on the values of the input components Cx, Cy, Cz.

The storage unit 54 stores both the values B1, B2, B3 and the values of the coefficients k1, k2, k3 of Equation 4. The values B1, B2, B3 depend on the application. In the embodiment discussed with respect to FIG. 2 for a spectral sequential display 3 wherein the temporal flicker is minimized, the optimal drive value D4opt of the drive component D4 is defined by Equation 6. The coefficients TC41, TC42, TC43 do not dependent on the input color and can be pre-stored. Thus, for this embodiment, the values B1, B2, B3 are identical to the coefficients TC41, TC42, TC43, respectively. In the embodiment discussed with respect to FIG. 3 for an RGBW display 3 wherein the spatial homogeneity is optimized, the optimal drive value D4opt of the drive component D4 is defined by Equation 8. Also now, the coefficients TC41', TC42', TC43' do not dependent on the input color and can be pre-stored. Thus, for this embodiment, the values B1, B2, B3 are identical to the coefficients TC41', TC42', TC43', respectively.

The calculation unit 51 receives the input components Cx, Cy, Cz and the values B1, B2, B3 to determine the optimal drive value D4opt of the drive component D4 in accordance with Equation 6 or 8. The clipping unit 52 receives the optimal drive value D4opt and the border values D4min and D4max and supplies the optimal drive value D4opt'. The clipping unit 52 checks whether the optimal drive value D4opt calculated by the calculation unit 51 occurs within the valid range VR with the border values D4min and D4max as determined by the interval unit 50. If the optimal drive value D4opt occurs within the valid range VR, the optimal drive value D4opt' is equal to the optimal drive value D4opt. If the optimal drive value D4opt occurs outside the valid range VR, the optimal drive value D4opt' becomes equal to the border value D4min, or D4max which is closest to the optimal drive value D4opt.

The optimal drive value D4opt' is the output component D4 of the output signal DS of the conversion system 5. The calculation unit 53 calculates the other output components D1 to D3 by substituting the output component D4 into Equation 4.

It has to be noted that the embodiments are elucidated for N=4 for an equal luminance constraint for spectral sequential display 3 and for an RGBW display. However, the scope of the present invention is much wider as is defined by the claims. A same approach is possible for N>4. The addition of at least the linear equation which defines a value for a linear combination of a first subset of the N drive components D1, . . . , DN and a second subset of the N-drive components D1, . . . , DN to obtain an extended set of equations, will narrow the possible solutions to that defined by the constraint imposed by the linear equation. Such a linear equation imposes a weighted luminance constraint to the different sub-sets of drive components D1, . . . , DN. It is possible for N>4 to combine this luminance constraint with another constraint, such as for example a minimum of the maximum value of the drive components D1 to DN.

The algorithm is very attractive for portable or mobile applications which use a spectrum-sequential multi-primary display. However, the algorithm can be used in other spectrum-sequential applications as TV, computer, medical displays in which the advantages of the spectrum-sequential approach are desired, but the main disadvantage, which is the flicker, is avoided. The algorithm may only be used for the specific color components or for specific ranges of the input signal. For example, the algorithm may not include the drive components for sub-pixels which do not or only minimally contribute to flicker. Or, the algorithm is not used for saturated or bright colors.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A method of converting a three-primary input color signal (IS) comprising three input components (R, G, B) per input sample into an N-primary color drive signal (DS) comprising N·4 drive components (D1, . . . , DN) per output sample for driving N sub-pixels (SP1, . . . , SPN) of a color additive display, the N sub-pixels (SP1, . . . , SPN) having N primary colors, the method comprising the steps of:

deriving at least one linear equation defining a value for a combination of a first subset of the N drive components (D1, . . . , DN) and a second subset of the N-drive components (D1, . . . , DN), and including the at least one linear equation with a set of three equations defining a relation between the N drive components (D1, . . . , DN) and the three input components (R, G, B) to obtain an extended set of equations; and determining a solution for the N drive components (D1, . . . , DN) from the extended set of equations.

2. The method as claimed in claim 1, wherein the first subset comprises a first linear combination (LC1) of 1·M1<N of the N drive components (D1, . . . , DN), and the second subset comprises a second linear combination (LC2) of 1·M2<N of the N drive components (D1, . . . , DN), wherein the first linear combination (LC1) for M1=1, and/or the second linear combination (LC2) for M2=1 comprises a single one of the N drive components (D1, . . . , DN) only, the first linear combination (LC1) defines a first value of the first subset, the second linear combination (LC2) defines a second value of the second subset, and wherein drive components (D1, . . . , DN) contributing to the second linear combination (LC2) do not contribute to the first linear combination (LC1) and the other way around.

3. The method as claimed in claim 2, wherein M1 is equal to M and M2 is equal to N−M, and wherein the second linear combination (LC2) is subtracted from the first linear combination (LC1), and the value is substantially zero to obtain a substantially identical first and second linear combination.

4. The method as claimed in claim 3, wherein a first set of the sub-pixels (SP1, . . . , SPN) associated with the first subset of the M drive components (D1, . . . , DM) and a second set of the sub-pixels (SP1, . . . , SPN) associated with the second subset of the N−M drive components (DM+1, . . . , DN) are adjacently positioned.

5. The method as claimed in claim 4, wherein the first subset comprises a first drive component (D1), a second drive component (D2), and a third drive component (D3) for driving three non-white sub-pixels (SP1, SP2, SP3), and the second subset comprises a fourth drive component (D4) for driving a white sub-pixel (SP4).

6. The method as claimed in claim 5, wherein a first input component (R), a second input component (G), and a third input component (B) of the three input components (R, G, B) of a same input sample of the three-primary input color signal (IS) are mapped to the adjacently positioned three non-white sub-pixels (SP1, SP2, SP3) and the white sub-pixel (SP4).

7. The method as claimed in claim 5, wherein a particular input sample of a particular line of an input image defined by the three-primary input color signal (IS) is mapped to the three non-white sub-pixels (SP1, SP2, SP3), and wherein a further input sample adjacent to the particular input sample is mapped to the white sub-pixel (SP4).

8. The method as claimed in claim 5, wherein a color point of the white sub-pixel (SP4) coincides with a white point of the three non-white sub-pixels (SP1, SP2, SP3).

9. The method as claimed in claim 4, wherein the color additive display is a spectral sequential display wherein the first subset is displayed in a first frame and the second subset is displayed in a second frame succeeding the first frame.

10. The method as claimed in claim 9, wherein the first subset comprises a first set of drive components (D1, . . . , DN) for driving a first set of sub-pixels (SP1, . . . , SPN), and wherein the second subset comprises a second set of drive components (D1, . . . , DN) for driving a second set of sub-pixels (SP1, . . . , SPN), the sub-pixels (SP1, . . . , SPN) of the second set having other primary colors than the sub-pixels (SP1, . . . , SPN) of the first set.

11. The method as claimed in claim 1, wherein the N drive components (D1, . . . , DN) have valid ranges wherein their values are valid, and wherein the method further comprises:

determining whether the determining a solution of the extended set of equations provides a solution for values of the N drive components (D1, . . . , DN) which are valid, and if not;

clipping at least one of the values of the N drive components (D1, . . . , DN) to the nearest border of the valid ranges.

12. The method as claimed in claim 11, wherein N=4, wherein the method further comprises:

defining three functions (F1, F2, F3) representing three (D1, D2, D3) of the N drive components as a function of the remaining fourth one (D4) of the N drive components;

determining a valid range (VR) of the fourth drive component (D4) wherein all the four of the N drive components (D1, D2, D3, D4) have valid values; and clipping the value of the fourth drive component (D4) to the nearest border (D4min, D4max) of the valid range (VR) of the fourth drive component (D4) if the solution provides a value of the fourth drive component (D4) outside the valid range (VR) of the fourth drive component (D4).

13. A non-transitory computer-readable storage medium having stored thereon a computer program comprising processor readable code for causing a processor, executing the computer program, to carry out the method as claimed in claim 1, the processor readable code comprising:

code for deriving at least one linear equation defining a value for a combination of a first subset of the N drive components (D1, . . . , DN) and a second subset of the N-drive components (D1, . . . , DN), and including the at least one linear equation with a set of three equations defining a relation between the N drive component (D1, . . . , DN) and the three input components (R, G, B), to obtain an extended set of equations; and code for determining a solution for the N drive components (D1, . . . , DN) from the extended set of equations.

14. The non-transitory computer-readable storage medium as claimed in claim 13, wherein the computer program is a software plug-in in an image processing application.

15. A system for converting a three-primary input color signal (IS) comprising three input components (R, G, B) per input sample into an N-primary color drive signal (DS) comprising N=4 drive components (D1, . . . , DN) per output sample for driving N sub-pixels (SP1, . . . , SPN) of a color additive display, the N sub-pixels (SP1, . . . , SPN) having N primary colors, the system comprising:

means for deriving at least one linear equation defining a value for a combination of a first subset of the N drive components (D1, . . . , DN) and a second subset of the N-drive components (D1, . . . , DN), and including the at least one linear equation with a set of three equations defining a relation between the N drive components (D1, . . . , DN) and the three input components (R, G, B) to obtain an extended set of equations; and means for determining a solution for the N drive components (D1, . . . , DN) from the extended set of equations.

16. A display apparatus comprising the system as claimed in claim 15, a signal processor for receiving an input signal (IV) representing an image to be displayed to supply the three input components (R, G, B) to the system, and a display device for supplying the N drive components (D1, . . . , DN) to sub-pixels (SP1, . . . , SPN) of the display device.

17. A camera comprising the system as claimed in claim 15, and an image sensor supplying the three-primary color input signal (IS).

18. A portable device comprising the display apparatus as claimed in claim 16.

* * * * *